US010883368B2

(12) United States Patent
Liu

(10) Patent No.: US 10,883,368 B2
(45) Date of Patent: Jan. 5, 2021

(54) SCREW EXPANDER WITH ADJUSTABLE VALVE

(71) Applicant: Fu Sheng Industrial Co. Ltd., Taipei (TW)

(72) Inventor: Yao-Chung Liu, New Taipei (TW)

(73) Assignee: Fu Sheng Industrial Co. Ltd., Taipei (TW)

( * ) Notice: Subject to any disclaimer, the term of this patent is extended or adjusted under 35 U.S.C. 154(b) by 264 days.

(21) Appl. No.: 15/911,181

(22) Filed: Mar. 5, 2018

(65) Prior Publication Data

US 2018/0371934 A1 Dec. 27, 2018

(30) Foreign Application Priority Data

Jun. 23, 2017 (TW) ..... 106121001 A

(51) Int. Cl.
*F01C 20/12* (2006.01)
*F01C 1/16* (2006.01)

(52) U.S. Cl.
CPC ..... *F01C 20/12* (2013.01); *F01C 1/16* (2013.01); *F04C 2210/221* (2013.01)

(58) Field of Classification Search
CPC ..... F01C 1/16; F01C 20/12
See application file for complete search history.

(56) References Cited

U.S. PATENT DOCUMENTS 3,088,659 A * 5/1963 Nilsson ..... F01C 20/12 418/159
4,222,716 A 9/1980 Shaw
6,302,668 B1 * 10/2001 Lee ..... F04C 18/16 418/201.2

FOREIGN PATENT DOCUMENTS

| | | |
|---|---|---|
| CN | 200940571 | 8/2007 |
| CN | 103492675 | 1/2014 |
| DE | 202008013702 | 12/2008 |
| DE | 102011121274 | 8/2012 |
| DE | 102014000469 | 7/2015 |
| JP | S6260902 | 3/1987 |

OTHER PUBLICATIONS

German Patent Publication: DE-102011121274-A1, Device for converting energy by organic Rankine cycle, comprises organic working unit, which has working unit circuit, and arrangement for maximizing energy efficiency of organic Rankine cycle, Published on Aug. 16, 2012. (Year: 2012).*
German Patent Publication: DE-202008013702-U1, Applicant: Fu Sheng Ind Co Ltd, Published on Dec. 24, 2008. (Year: 2008).*
"Search Report of Europe Counterpart Application", dated Oct. 16, 2018, p. 1-p. 8.

* cited by examiner

*Primary Examiner* — Mary Davis
(74) *Attorney, Agent, or Firm* — JCIPRNET

(57) ABSTRACT

A screw expander includes a main body, at least an expansion screw and an adjusting component. The main body has a high pressure region, an expansion region and a low pressure region. The expansion screw is disposed at the expansion region and has an air inlet end and an air outlet end, wherein the air inlet end is connected to the high pressure region, and the air outlet end is connected to the low pressure region. The adjusting component covers the expansion screw, and is adapted to move relatively to the expansion screw to change an opening area of the air inlet end or an opening area of the air outlet end, such that a pressure of an air exhausted from the air outlet end is adjusted.

5 Claims, 4 Drawing Sheets

SCREW EXPANDER WITH ADJUSTABLE VALVE

CROSS-REFERENCE TO RELATED APPLICATION

This application claims the priority benefit of Taiwan application serial no. 106121001, filed on Jun. 23, 2017. The entirety of the above-mentioned patent application is hereby incorporated by reference herein and made a part of this specification.

BACKGROUND

Technical Field

The disclosure relates to an expander, particularly related to a screw expander.

Description of Related Art

With the development of industrialization, human demand for electricity has increased accordingly. Therefore, many of power generation methods have developed. Among them, the screw expander is driven by an input of high pressure air, and thus generates power.

In general, the greater the differences between the pressure of an air outlet end of the screw expander and the pressure of an exhausted air reaching the low pressure region are, the greater the power consumption is. Therefore, how to effectively control the pressure of the air outlet end of the screw expander to be consistent with the pressure of the low pressure region has become an important issue of designing the screw expander.

SUMMARY

The invention provides a screw expander, which adjusts the pressure of an air exhausted from an air outlet end of an expansion screw.

The screw expander of the invention includes a main body, at least an expansion screw and an adjusting assembly. The main body has a high pressure region, an expansion region and a low pressure region. The expansion screw is disposed at the expansion region and has an air inlet end and an air outlet end, wherein the air inlet end is connected to the high pressure region, and the air outlet end is connected to the low pressure region. The adjusting assembly covers the expansion screw, and is adapted to move relatively to the expansion screw to change an opening area of the air inlet end or an opening area of the air outlet end, such that a pressure of an air exhausted from the air outlet end is adjusted.

In an embodiment of the invention, an end of the adjusting assembly has a recess. When the adjusting assembly moves to a first position, the recess is aligned with the air inlet end to increase an opening area of the air inlet end. When the adjusting assembly moves to a second position, the recess is dislocated with the air inlet end to reduce the opening area of the air inlet end.

In an embodiment of the invention, the end of the adjusting assembly has the recess. When the adjusting assembly moves to the first position, the recess is aligned with the air outlet end to increase the opening area of the air outlet end. When the adjusting assembly moves to the second position, the recess is dislocated with the air outlet end to reduce the opening area of the air outlet end.

In an embodiment of the invention, the adjusting assembly is adapted to move back and forth along a move direction. The move direction is parallel to a rotation axis of the expansion screw.

In an embodiment of the invention, the adjusting assembly has a guide slot. The main body has a guide convex, and the adjusting assembly is slidably disposed on the guide convex by the guide slot.

In an embodiment of the invention, the screw expander includes a control module. The control module is adapted to sense the pressure of an expansion region and the pressure of a low pressure region, and thus controls movements of the adjusting assembly.

In an embodiment of the invention, the main body or the adjusting assembly has a passageway. The passageway is connected to the expansion region. The control module senses the pressure of the expansion region through the passageway.

In an embodiment of the invention, the expansion screw has a plurality of screw thread segments. A first screw thread of the screw thread segments is adjacent to the air outlet end. A second screw thread of the screw thread segments is adjacent to the first screw thread but is not adjacent to the air outlet end. The passageway is connected to the second screw thread.

In an embodiment of the invention, a distance of the passageway and the air outlet end is shorter than a distance of the passageway and the air inlet end.

In an embodiment of the invention, a length of the adjusting assembly is greater than a length of the expansion screw.

Based on the above, in the screw expander of the invention, the adjusting assembly moves relatively to the expansion screw to change the coverage rate of the adjusting assembly covering the air inlet end of the expansion screw or the coverage rate of the adjusting assembly covering the air outlet end of the expansion screw. Thus, the opening area of the air inlet end or the opening area of the air outlet end is changed. By changing the opening area of the air inlet end or changing the opening area of the air outlet end, the pressure of the air exhausted from the air outlet end is adjusted, such that the pressure of the air exhausted from the air outlet end is equal to the pressure of the low pressure region. The power consumption of the screw expander is thus reduced.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
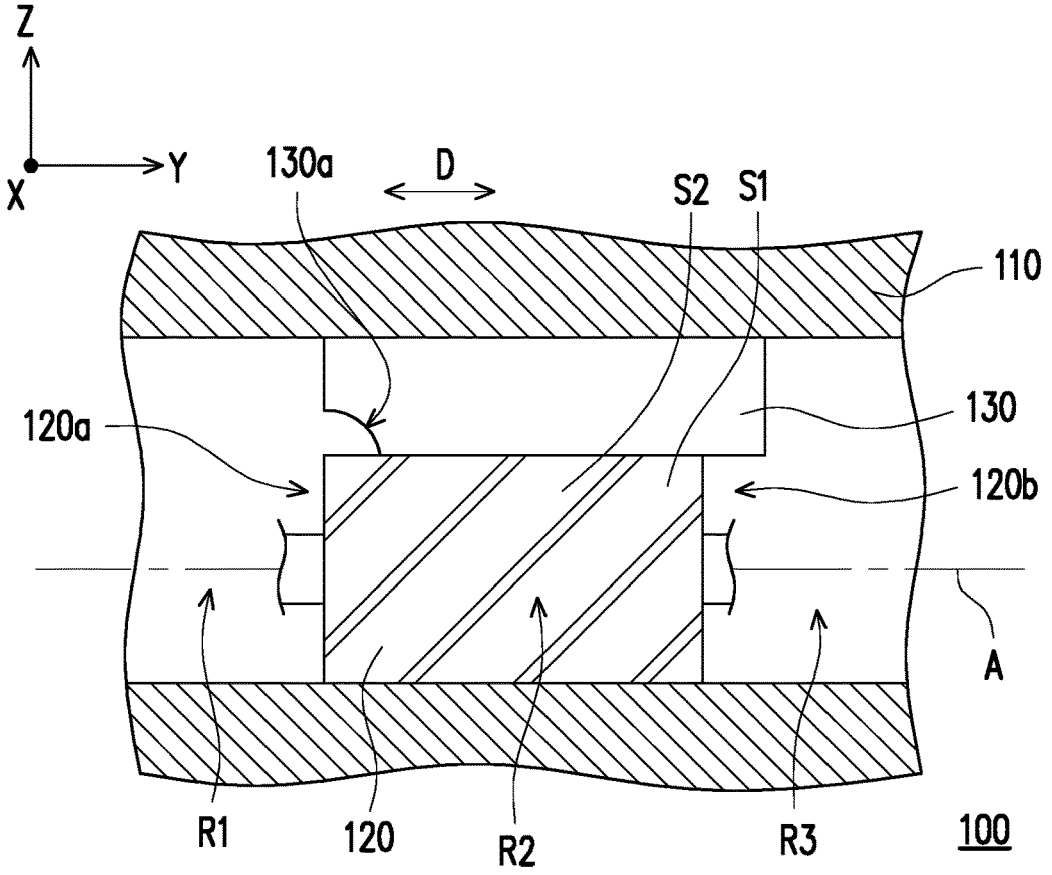
FIG. 1A is a schematic view of some of components of a screw expander according to an embodiment of the invention.

FIG. 1A is a schematic view of some of components of a screw expander according to an embodiment of the invention. Please refer to FIG. 1A. A screw expander 100 of the embodiment includes a main body 110 and at least an expansion screw 120. The main body 110 has a high pressure region R1, an expansion region R2, and a low pressure region R3. The expansion screw 120 is disposed at the expansion region R2 and has an air inlet end 120*a* and an air outlet end 120*b*. The air inlet end 120*a* is connected to the high pressure region R1. The air outlet end 120*b* is connected to the low pressure region R3. The high pressure air inputted from the air inlet end 120*a* drives the expansion screw 120 to rotate, such that the expansion screw 120 proceeds work, such as power generation. FIG. 1A simply illustrates the single expansion screw 120. However, the invention is not limited thereto. It can also be in the shape of twin expansion screw.

Figure 2:
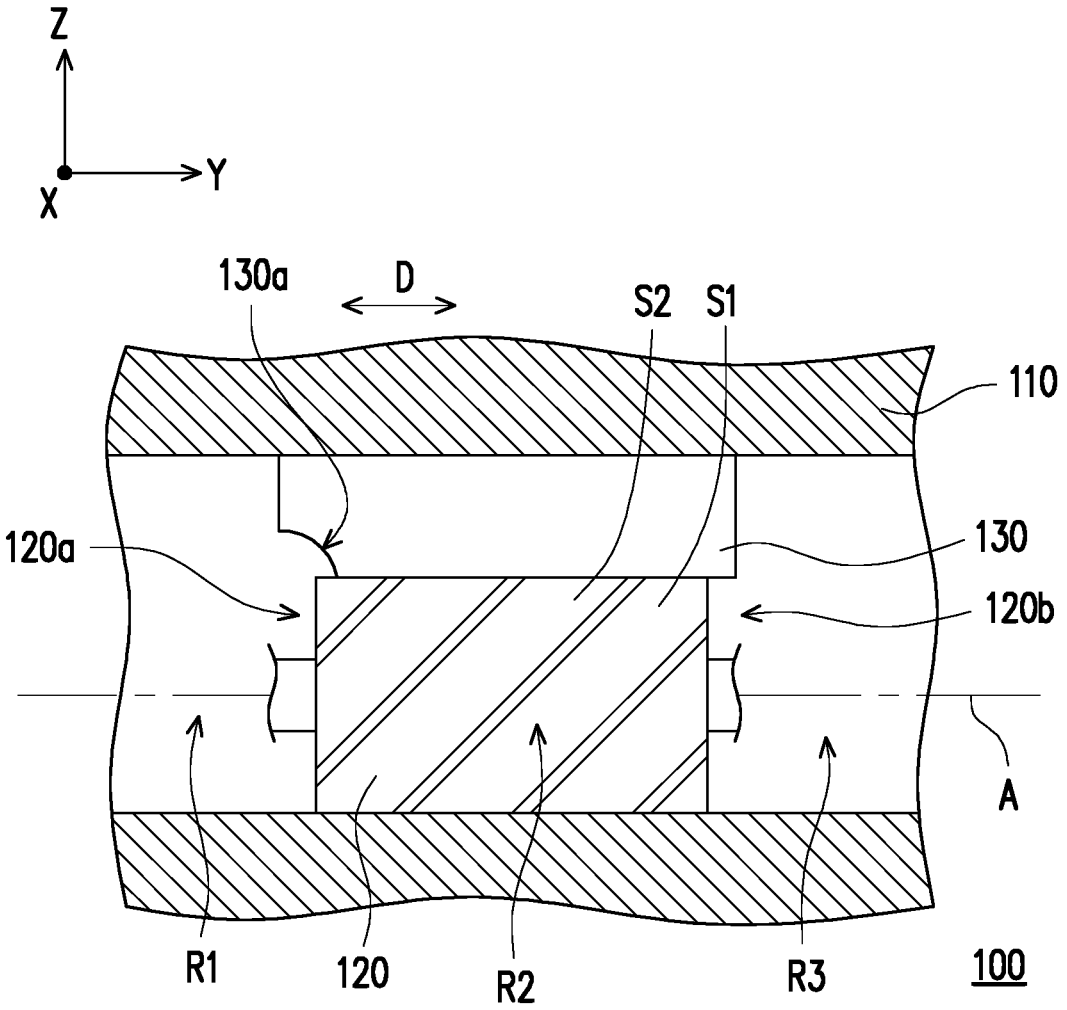
FIG. 2 illustrates the movement of an adjusting assembly of FIG. 1A.

FIG. 2 illustrates the movement of an adjusting assembly of FIG. 1A. The screw expander 100 of the embodiment further includes an adjusting assembly 130. The adjusting assembly 130 covers at least part of the outside of the expansion screw 120, and is adapted to move relatively to the expansion screw 120 along the move direction D between the state illustrated as FIG. 1A and the state illustrated as FIG. 2, and the opening area of the air inlet end 120*a* is changed to adjust the pressure of the air exhausted from the air outlet end 120*b* of the expansion screw 120, such that the air exhausted from the air outlet end 120*b* of the expansion screw 120 is equal to the pressure of the low pressure region R3. The power consumption of the screw expander 100 is thus reduced. In the embodiment, the move direction D of the adjusting assembly 130 is, for example, parallel to a rotation axis A of the expansion screw 120.

Specifically, the end of the adjusting assembly 130 which is closer to a high pressure region R1 has a recess 130*a*. When the adjusting assembly 130 moves to a first position illustrated as FIG. 1A, the recess 130*a* is aligned with the air inlet end 120*a* to increase the opening area of air inlet end 120*a*. At this time, the air pressure entering the expansion screw 120 drops, such that the air pressure exhausted from the air outlet end 120*b* drops accordingly. In contrast, when the adjusting assembly 130 moves to the second position illustrated as FIG. 2, the recess 130*a* is dislocated with the air inlet end 120*a* to reduce the opening area of the inlet end 120*a*. At this time, the air pressure entering the expansion screw 120 pressure rises, such that the air pressure exhausted from the air outlet end 120*b* rises accordingly.

Figure 3:
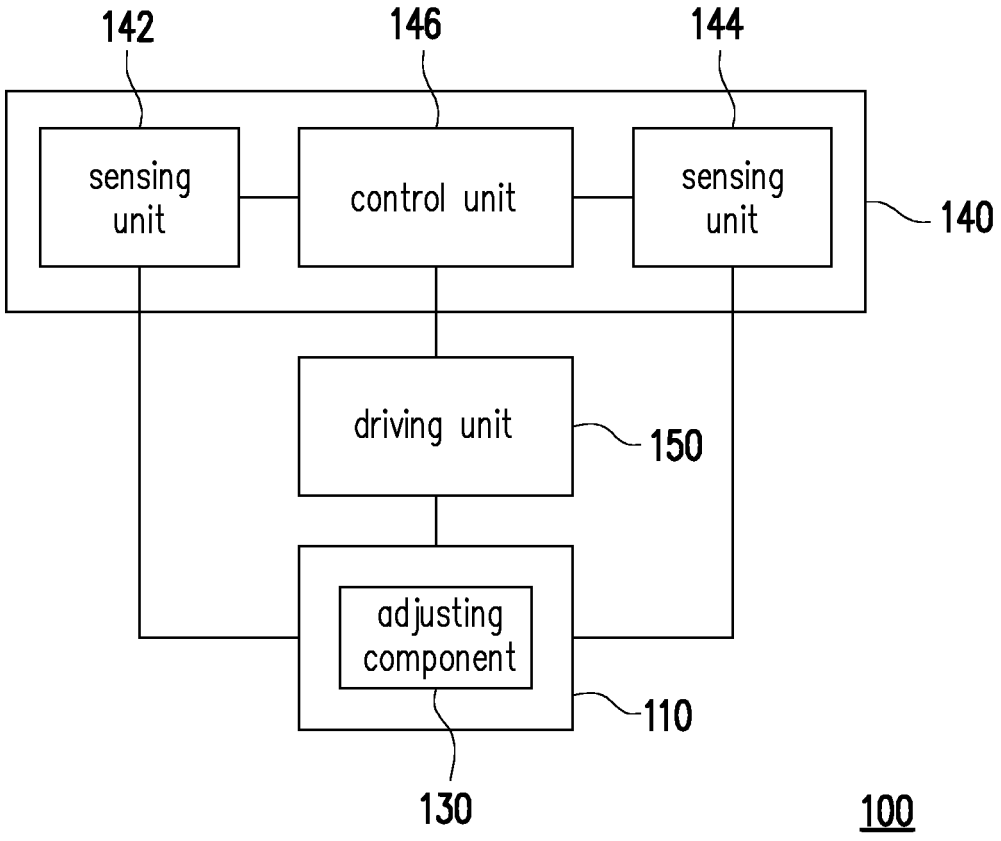
FIG. 3 is a block diagram of some of components of the screw expander of FIG. 1A.

FIG. 3 is a block diagram of some of components of the screw expander of FIG. 1A. Please refer to FIG. 1A and FIG. 3. The screw expander 100 of the embodiment further includes a control module 140. The control module 140 is adapted to sense the pressure of the expansion region R2 of the main body 110 and the pressure of the low pressure region R3 of the main body 110 respectively by a sensing unit 142 and a sensing unit 144. The control unit 146 controls the movements of the adjusting assembly 130 by the driving unit 150 according to the sensing signal from the sensing unit 142 and the sensing unit 144, and makes the air pressure exhausted from the air exhausted from the air outlet end 120*b* of the expansion screw 120 is equal to the pressure of the low pressure region R3. The sensing unit 142 and the sensing unit 144 are, for example, suitable kinds of pressure sensing components. The driving unit 150 is, for example, a suitable kind of actuator. However, the invention is not limited thereto.

Figure 1B:
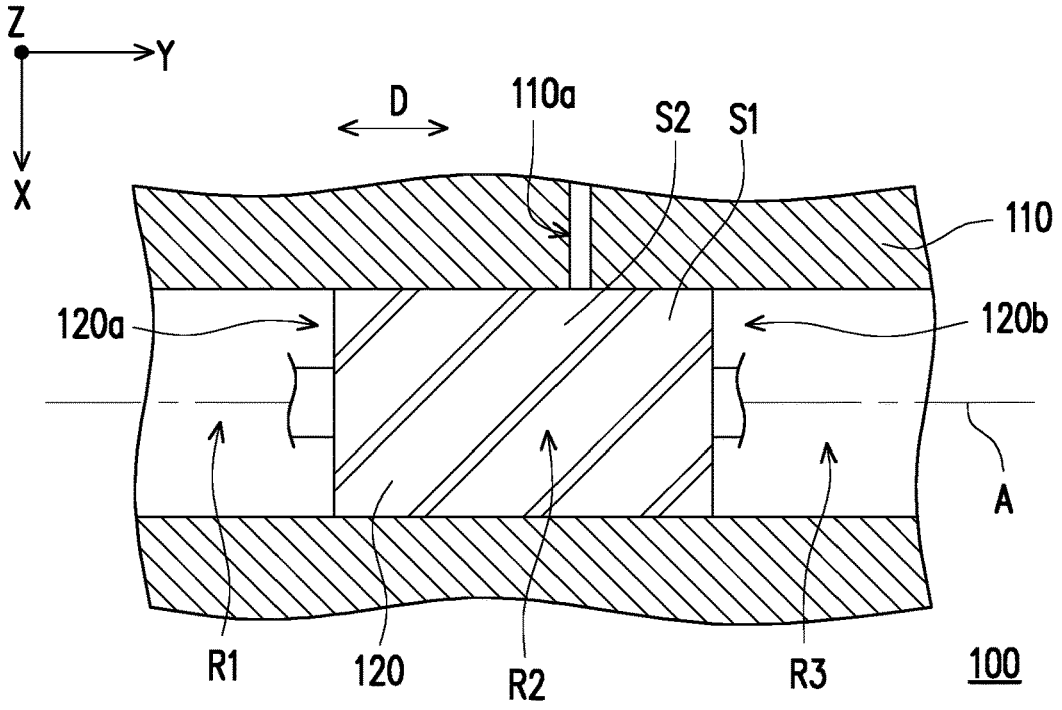
FIG. 1B is another cross-section of a schematic view of some of components of a screw expander of FIG. 1A.

FIG. 1B is another cross-section of a schematic view of some of components of a screw expander of FIG. 1A. In detail, in the embodiment, the main body 110 illustrated as FIG. 1B has a passageway 110*a*. The passageway 110*a* is connected to the expansion region R2. The sensing unit 142 of the control module 140 senses the pressure of the expansion region R2 through the passageway 110*a*. That is, when the recess 130*a* is at the air inlet end 120*a*, the passageway 110*a* is disposed at the main body 110. Furthermore, the expansion screw 120 has a plurality of screw thread segments. A first screw thread S1 of the screw thread segments is adjacent to the air outlet end 120*b*. A second screw thread S2 is adjacent to the first screw thread S1, but is not adjacent to the air outlet end 120*b*. The passageway 110*a* of the main body 110 is connected to the second screw thread S2 to positively sense the air pressure of the expansion region R2, which is not yet, but is about to reach the air outlet end 120*b*. Under this configuration, the distance of the passageway 110*a* of the main body 110 and the air outlet end 120*b* of the expansion screw 120 moving along the move direction D is, for example, shorter than the distance of the passageway 110*a* of the main body 110 and the air inlet end 120*a* of the expansion screw 120 moving along the move direction D. However, the invention is not limited thereto. In addition, the length of the adjusting assembly 130 of the embodiment moving along the move direction D is greater than, for example, the distance of the expansion screw 120 moving along the move direction D to effectively covers the expansion screw 120. However, the invention is not limited thereto. It should be noted that, to make the drawings clear, FIG. 1A and FIG. 1B are illustrated in cross-section manners of parts of the main body 110. In fact, the main body 110 and the adjusting assembly 130 both cover the expansion screw 120. The expansion screw 120 is only exposed at part of the areas of the air inlet end 120*a* and the air outlet end 120*b* to provide air inlet and air outlet.

Figure 4:
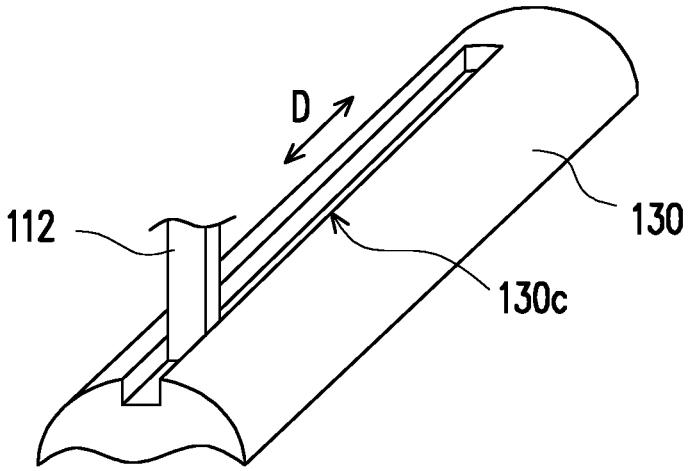
FIG. 4 is a schematic partial view of a main body and an adjusting assembly of FIG. 1A.

FIG. 4 is a schematic partial view of a main body and an adjusting assembly of FIG. 1A. Please refer to FIG. 4. The adjusting assembly 130 of the embodiment has a guide slot 130*c*. The main body 110 (illustrated as FIG. 1A) has a guide convex 112. The adjusting assembly 130 is slidably disposed on a guide convex 112 along the move direction D by the guide slot 130*c*, such that the adjusting assembly 130 smoothly moves along the move direction D. In other embodiments, the adjusting assembly 130 slidably disposed on the guide convex 112 could be carried out by other suitable structures. However, the invention is not limited thereto.

Figure 5:
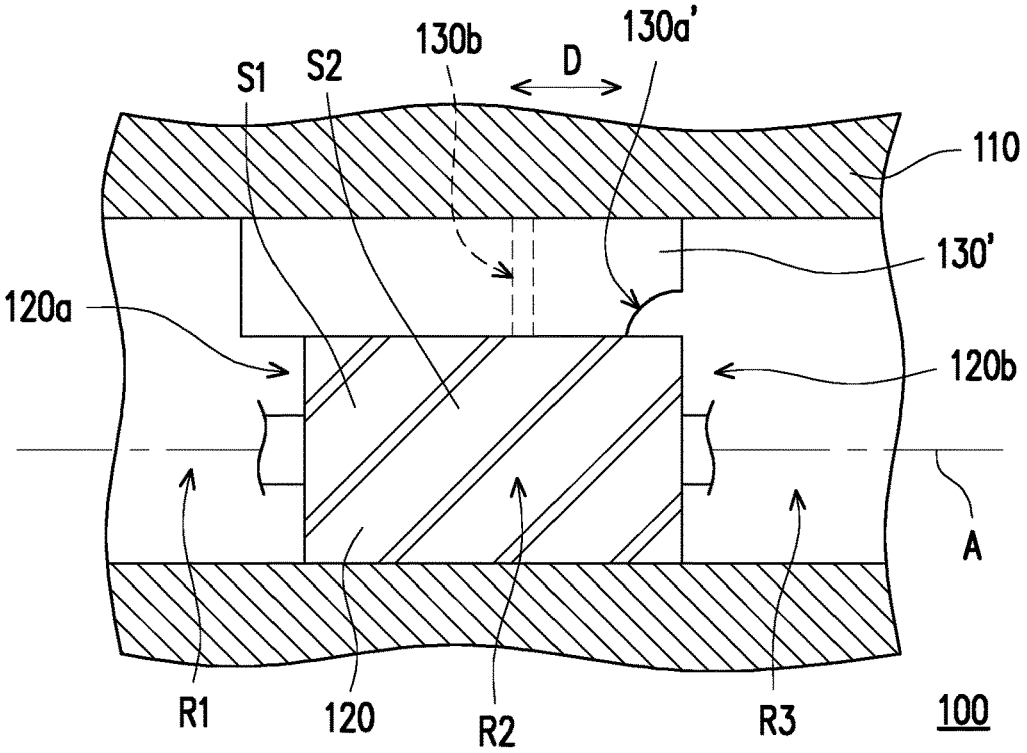
FIG. 5 is a schematic view of some of components of a screw expander according to another embodiment of the invention.
Figure 6:
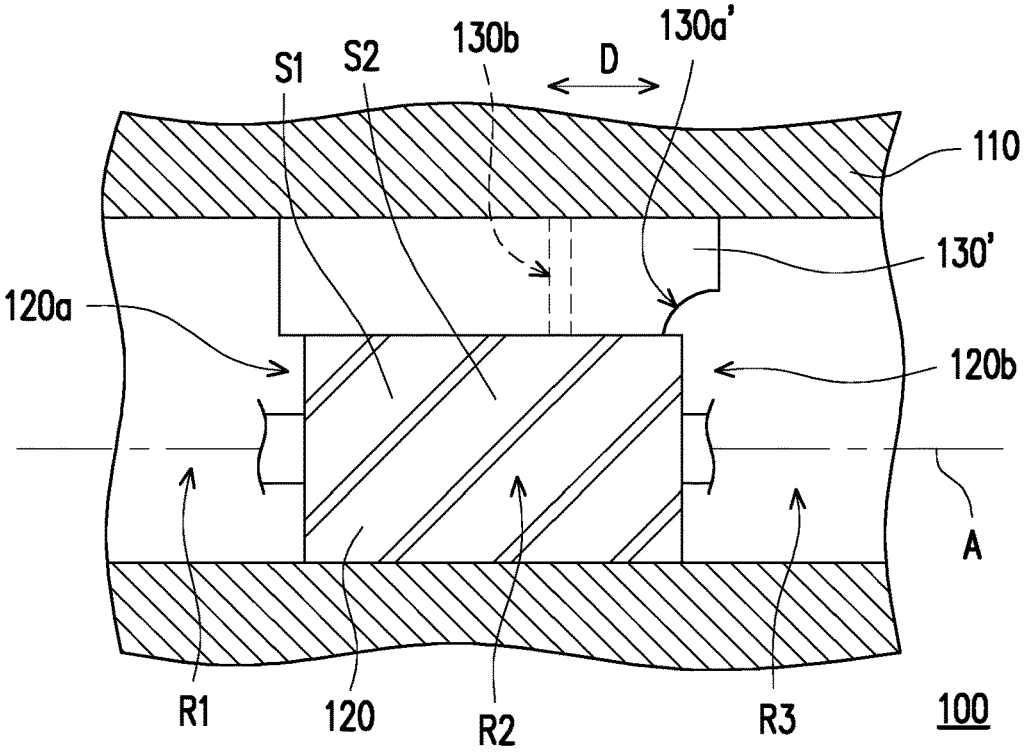
FIG. 6 illustrates the movement of an adjusting assembly of FIG. 5.

FIG. 5 is a schematic view of some of components of a screw expander according to another embodiment of the invention. FIG. 6 illustrates the movement of an adjusting assembly of FIG. 5. The difference between the embodiments illustrated as FIG. 5 and FIG. 6 and the embodiments illustrated as FIG. 1A, FIG. 1B, and FIG. 2 is that a recess 130*a*' of an adjusting assembly 130' is located at the end adjacent the low pressure region R3 of the adjusting assembly 130. When the adjusting assembly 130' moves to the first position illustrated as FIG. 3, the recess 130*a*' is aligned with the air outlet end 120*a* to increase the opening area of the air outlet end 120*a*, such that the air pressure exhausted from the air outlet end 120*b* drops. In contrast, when the adjusting assembly 130 moves to the second position illustrated as FIG. 4, the recess 130*a*' is dislocated with the air outlet end 120*a* to reduce the opening area of the air outlet end 120*a*, such that pressure of the air exhausted from the air outlet end 120*b* rises. Besides, in the embodiments illustrated as FIG. 5 and FIG. 6, the passageway 130*b* is formed on the adjusting assembly 130', and is not consistent with the embodiment illustrated as FIG. 1B that the passageway 110*a* is formed on the main body 110. That is, when the recess 130*a*' is at air outlet end 120*b*, the passageway 130*b* is disposed at the adjusting assembly 130'. The descriptions of the rest of the configuration and effects of the passageway 130*b* are similar to those of the passageway 110*a* illustrated as FIG. 1B and will not be repeated for this embodiment.

In summary, in the screw expander of the invention, the adjusting assembly moves relatively to the expansion screw and change the coverage rate of the adjusting assembly covering the air inlet end or the coverage rate of the adjusting assembly covering the air outlet end of the expansion screw, and the opening area of the air inlet end or the opening area of the air outlet end is thus changed. With changes of the opening area of the air inlet end or changes of the opening area of the air outlet end, the pressure of an air exhausted from the air outlet end is adjusted. The pressure of the air exhausted from the air outlet end of expansion screw is equal to the distance of the low pressure region. The power consumption of the screw expander is thus reduced.

Although the embodiments are already disclosed as above, these embodiments should not be construed as limitations on the scope of the invention. It will be apparent to those ordinarily skilled in the art that various modifications and variations can be made to the disclosed embodiments without departing from the scope or spirit of this invention. In view of the foregoing, it is intended that the invention covers modifications and variations provided that they fall within the scope of the following claims and their equivalents.

What is claimed is:

1. A screw expander comprising:

a main body, having a high pressure region, an expansion region, and a low pressure region;

at least an expansion screw, disposed at the expansion region and having an air inlet end and an air outlet end, wherein the air inlet end is connected to the high pressure region, and the air outlet end is connected to the low pressure region;

an adjusting assembly, covering the expansion screw, and adapted to move relatively to the expansion screw to change an opening area of the air inlet end or an opening area of the air outlet end, such that a pressure of an air exhausted from the air outlet end is adjusted; and a control module, wherein the control module is adapted to sense pressure of the expansion region and pressure of the low pressure region, and thus controls movements of the adjusting assembly, wherein an end of the adjusting assembly has a recess; when the adjusting assembly moves to a first position, the recess is aligned with the air inlet end or the air outlet end to increase the opening area of the air inlet end or the opening area of the air outlet end; when the adjusting assembly moves to a second position, the recess is dislocated with the air inlet end or the air outlet end to reduce the opening area of the air inlet end or the opening area of the air outlet end, wherein along a rotation axis of the expansion screw, a width of the recess is less than a width of a screw thread segment of the expansion screw, wherein the main body or the adjusting assembly has a passageway, the passageway is connected to the expansion region, the control module senses the pressure of the expansion region through the passageway, and a distance of the passageway and the air outlet end is shorter than a distance of the passageway and the air inlet end.

2. The screw expander according to claim 1, wherein the adjusting assembly is adapted to move back and forth along a move direction, and the move direction is parallel to the rotation axis of the expansion screw.

3. The screw expander according to claim 1, wherein the adjusting assembly has a guide slot, the main body has a guide convex, and the adjusting assembly is slidably disposed on the guide convex by the guide slot.

4. The screw expander according to claim 1, wherein the expansion screw has a plurality of the screw thread segments, a first screw thread of the screw thread segments is adjacent to the air outlet end, a second screw thread of the screw thread segments is adjacent to the first screw thread but is not adjacent to the air outlet end, and the passageway is connected to the second screw thread.

5. The screw expander according to claim 1, wherein a length of the adjusting assembly is greater than a length of the expansion screw.

* * * * *